United States Patent [19]

Bultman et al.

[11] Patent Number: 4,484,990

[45] Date of Patent: Nov. 27, 1984

[54] MIST SUPPRESSANT FOR SOLVENT EXTRACTION METAL ELECTROWINNING

[75] Inventors: David A. Bultman; Maynard H. Olson, both of St. Paul, Minn.

[73] Assignee: Minnesota Mining and Manufacturing Company, St. Paul, Minn.

[21] Appl. No.: 159,840

[22] Filed: Jun. 16, 1980

[51] Int. Cl.[3] ..... C25C 1/12

[52] U.S. Cl. ..... 204/106; 204/107; 204/108; 204/112; 204/113; 204/DIG. 1; 75/101 BE

[58] Field of Search ..... 204/DIG. 1, 106–108, 204/112–113; 75/101 BE

[56] References Cited

U.S. PATENT DOCUMENTS

| | | | |
|---|---|---|---|
| 2,595,387 | 5/1951 | Kalling et al. | 204/112 |
| 2,732,398 | 1/1956 | Brice et al. | 260/503 |
| 2,750,334 | 6/1956 | Brown | 204/51 |
| 2,750,335 | 6/1956 | Brown | 204/51 |
| 2,750,336 | 6/1956 | Brown | 204/51 |
| 2,750,337 | 6/1956 | Brown | 204/51 |
| 2,764,602 | 9/1956 | Ahlbrecht | 260/404.5 |
| 2,764,603 | 9/1956 | Ahlbrecht | 260/404.5 |
| 2,803,656 | 8/1957 | Ahlbrecht et al. | 260/556 |
| 2,809,990 | 10/1957 | Brown | 260/534 |
| 2,913,377 | 11/1959 | Brown | 204/DIG. 1 |
| 3,147,064 | 9/1964 | Brown et al. | 8/116.2 |
| 3,255,131 | 6/1966 | Ahlbrecht et al. | 260/22 |
| 3,450,755 | 6/1969 | Ahlbrecht | 260/556 |
| 3,948,747 | 4/1976 | Cordiano et al. | 204/242 |
| 4,000,168 | 12/1976 | Bertocchio et al. | 260/404.5 |
| 4,042,522 | 8/1977 | Falk | 252/8.05 |
| 4,069,158 | 1/1978 | Bertocchio et al. | 252/3 |
| 4,069,244 | 1/1978 | Mueller | 260/326.43 |
| 4,090,967 | 5/1978 | Falk | 252/3 |
| 4,161,590 | 7/1979 | Mueller | 260/326.42 |
| 4,161,602 | 7/1979 | Mueller | 546/335 |

FOREIGN PATENT DOCUMENTS

| | | | |
|---|---|---|---|
| 432809 | 3/1973 | Australia | 260/556 |
| 1022005 | 3/1966 | United Kingdom | 204/DIG. 1 |

OTHER PUBLICATIONS

Agers et al, Cu Recovery from Acid Sol'ns Using Liquid Ion Exchange, p. 8.

"3M Brand Fluorochemical Surfactants Tech. Info. 36–37 (1963), p. 7.

Merigold; C. R. and House, J. E., "Applications of Liquid Ion Exchange Technology to Recovery of Cu", Cu Technology Seminar, Wash. D.C. 12/1975, pp. 2,3.

Tuddenbam et al., "Cu", Kirk–Othmer Encyclopedia of Chem. Tech. 3rd Ed., vol. 6, 850–852 (1979).

McGarr, "Solvent Extraction Stars in Making Ultrapure Cu", Chem. Eng. vol. 77, #17, 8–10–70, pp. 82–84.

Chem. Abstracts, vol. 81, 1974, 123415u (p. 180).

Guenthner & Victor, I&EC Product Res. & Dev., 1(3) 165–169, 1962.

Kordosky, G. A., Ed., The Chemistry of Metals Recovery Using LIX Reagents, p. 8.

Merigold et al., LIX 64N–The Recovery of Cu from Ammoniacal Leach Sol'ns, p. 8.

*Primary Examiner*—R. L. Andrews

*Attorney, Agent, or Firm*—Donald M. Sell; James A. Smith; David R. Cleveland

[57] ABSTRACT

The formation of acid mist or spray over metal electrowinning tanks, such as in the electrowinning of copper obtained by solvent extraction, is substantially inhibited or eliminated by electrowinning the metal from electrolyte containing certain cationic and/or amphoteric fluoroaliphatic surfactants.

18 Claims, No Drawings

MIST SUPPRESSANT FOR SOLVENT EXTRACTION METAL ELECTROWINNING

TECHNICAL FIELD

This invention relates to the recovery of metal values from a solution thereof by the solvent extraction-electrowinning process. Also, this invention relates to the recovery of copper by the solvent extraction-electrowinning process. In addition, this invention relates to a method for inhibiting the formation of acidic mist above electrowinning tanks.

BACKGROUND ART

The process for recovery of elemental metal values from ores and processing liquids by solvent extraction-electrowinning (hereafter, "SX-EW") is well-known. Briefly, the process is carried out using a metal-bearing aqueous solution. Such metal-bearing solution is obtained by dissolving (generally from an ore) the desired metal in an aqueous leach liquor, or by using a metal-bearing solution such as process effluent. The resulting solution of metal values is mixed with a water-immiscible organic solvent (e.g., kerosene) containing a water-insoluble ion exchange composition having selective affinity for the desired metal values. The ion exchange composition preferentially extracts the desired metal values from the aqueous solution. The aqueous and organic phases are separated. The aqueous solution, now metal-depleted, is usually referred to as "raffinate". The raffinate can be recycled as leach liquor (in a leaching process) or discarded (in a process such as recovery of metal from process effluent). The organic phase (which contains ion exchange composition and the extracted metal values) is usually referred to as "loaded organic". The desired metal values are removed from the loaded organic by mixing with an aqueous strip solution containing strong acid such as sulfuric, phosphoric, or perchloric acid, and having lower pH than the above metal-bearing aqueous solution. The aqueous strip solution extracts the desired metal values into the aqueous phase. After separation of the organic and aqueous phases, the desired metal values are present in the aqueous strip solution, and the resulting metal-enriched strip solution is usually referred to as "electrolyte" or "pregnant electrolyte". The metal-depleted organic phase is usually referred to as "spent organic". Such spent organic can be recycled for fresh loading with metal values by mixing with metal-bearing aqueous solution. Metal isolation as described above is generally referred to as "solvent extraction" (hereafter, "SX"). The desired metal is recovered in purified form by electroplating the metal from the electrolyte. Such recovery by electroplating is generally referred to as "electrowinning" (hereafter "EW"). After recovery of the desired metal, the metal-depleted electrolyte is usually referred to as "spent electrolyte". Such spent electrolyte can be recycled as aqueous strip solution for fresh loading with metal values by mixing with loaded organic.

The SX-EW process is carried out commercially on a continuous basis and is used for the recovery of metals such as copper or nickel. Industrial use of the SX-EW process is increasing due to its efficiency, low energy costs, low pollution levels, and simplified materials handling requirements. The SX-EW process is described, for example, in Tuddenham, W. M. and Dougall, P. A., "Copper", *Kirk Othmer Encyclopedia of Chemical Technology*, 3rd Ed., Vol. 6, 850–852 (1979), McGarr, H. J., "Solvent Extraction Stars in Making Ultrapure Copper", *Chemical Engineering*, Vol. 77, No. 17, Aug. 10, 1970, pp. 82–84, and Merigold, C. R. and House, J. E., "The Application of Liquid Ion Exchange Technology to the Recovery of Copper" (a paper presented at the Copper Technology Seminar in Washington, D.C., December 1975). Flow charts showing the SX-EW process are included, for example, in Tuddenham et al, id at 851 and in McGarr, id at 83–84.

During the electrowinning step, elemental metal is plated out at the electrowinning cathode and oxygen evolves at an insoluble anode. The evolution of oxygen gas entrains strong acid electrolyte, carrying it into the air above the electrowinning tank in the form of a fine mist or spray. This mist or spray then spreads throughout the electrowinning tankhouse. The acidic mist is corrosive and a health hazard and can cause extreme discomfort to the skin, eyes, and respiratory systems of tankhouse workers, especially during hot weather conditions. This has caused high turnover among tankhouse workers.

A similar mist-formation problem once occurred in the chromium plating industry. Chromium plating companies employed extensive ventilation above plating tanks, clothed workers in heavy protective garments, and floated plastic balls on the surface of the electrolyte to reduce mist-formation and problems caused by such mist. These expedients were cumbersome and insufficiently effective. The use of such expedients was made unnecessary after the discovery and use of certain stable fluorochemical surfactants which, when added to a chromium plating bath, promoted formation of a foam at the surface of the plating bath which effectively eliminated chromic acid mist formation. Such fluorochemical surfactants are described, for example, in U.S. Pat. Nos. 2,750,334, 2,750,335, 2,750,336, and 2,750,337.

As described above, the SX-EW process is generally carried out on a continuous basis, with recycling and regeneration of the metal-bearing aqueous solution, the organic phase, and the electrolyte. Thus, after a portion of the desired metal has been plated from the electrolyte, the spent electrolyte is mixed with fresh loaded organic. This process subjects the electrolyte to a series of stages in which the electrolyte is mixed with loaded organic, phase separated, subjected to electroplating conditions, and recycled. Certain fluorochemical foam-forming surfactants such as those commonly used in the chromium plating industry proved to be unsatisfactory for inhibiting acidic mist formation above electrowinning tanks used in the SX-EW process. For example, the conventional chrome plating fluorochemical mist suppressant $C_8F_{17}SO_3K$ gave good initial foam formation and mist suppression above a copper electrowinning tank, but the fluorochemical was rapidly extracted into the organic phase during recycling of the electrolyte, and subsequently was extracted into the raffinate. In addition, the fluorochemical surfactant $C_8F_{17}SO_3K$ was found to interfere with copper recovery and to retard phase separation between organic and aqueous phases when used with ion exchange compounds such as "Acorga P5300" (commercially available from Imperial Chemical Industries, Ltd.) and "LIX 64N" (commercially available from Henkel Corporation).

In order to suppress acidic mist formation in the electrowinning tankhouse, SX-EW metal producers have utilized mist suppression expedients such as those used in the chrome plating industry, before discovery of suitable foam-forming mist suppressing agents. For example, SX-EW producers employ extensive ventilation in the electrowinning tankhouse, clothe workers in protective garments, and float plastic balls on the surface of the electrowinning electrolyte. These means are cumbersome and only partially effective, especially during hot weather. Also, electrowinning tanks have been covered with polypropylene tank blankets, and in U.S. Pat. No. 3,948,747 there is described a mist suppressing means for copper SX-EW carried out by floating elongated members (such as plastic rods) on the electrowinning electrolyte.

SUMMARY OF INVENTION

It is an object of the present invention to suppress mist formation in the solvent extraction-electrowinning processing of metals. It is also an object of this invention to suppress mist formation in the solvent extraction-electrowinning processing of copper and nickel.

Accordingly, the present invention provides, in one aspect, a process for recovery of metal values by liquid-liquid solvent extraction of said metal values from metal-bearing aqueous solution, stripping of said metal values into acidic aqueous solution containing strong acid, and electrowinning of said metal values from an electrolytic cell, said cell comprising one or more insoluble anodes, a metallic cathode, and electrolyte containing said strong acid and said metal values, said process including recycling of said electrolyte, wherein the improvement comprises electrowinning said metal values from electrolyte containing sufficient fluoroaliphatic surfactant to provide mist-inhibiting foam on the surface of said electrolyte, said surfactant having at least one cationogenic group which is the radical of a base having a ionization constant in water at 25° C. of at least about $10^{-6}$, and containing at least about 30 weight percent fluorine in the form of carbon-bonded fluorine in a fluoroaliphatic radical, said fluoroaliphatic radical having at least 4 carbon atoms and at least a terminal perfluoromethyl group.

The present invention also provides a process for the recovery of metal values from metal-bearing aqueous solutions, comprising the steps of:

(a) mixing said metal-bearing aqueous solution with water-immiscible organic solvent containing water-insoluble organic ion exchange composition, said composition having selective affinity for said metal values, thereby forming metal-bearing organic solution and metal-depleted aqueous solution;

(b) separating said metal-bearing organic solution and said metal-depleted aqueous solution;

(c) contacting said metal-bearing organic solution with aqueous strip solution comprising strong acid and less than or equal to 0.02 weight percent of fluoroaliphatic surfactant, said surfactant having at least one cationogenic group which is the radical of a base having an ionization constant in water at 25° C. of at least about $10^{-6}$, and containing at least about 30 weight percent fluorine in the form of carbon-bonded fluorine in a fluoroaliphatic radical, said fluoroaliphatic radical having at least 4 carbon atoms and at least a terminal perfluoromethyl group, thereby forming metal-enriched aqueous strip solution and metal-depleted organic solution, said metal-enriched aqueous strip solution having a surface tension at 25° C. which is less than or equal to about 35 dynes/cm;

(d) separating said metal-depleted organic solution and said metal-enriched aqueous strip solution;

(e) electroplating said metal values onto a metallic cathode using said metal-enriched aqueous strip solution as electrolyte in an electrolytic bath, by passing direct electric current between said cathode and an insoluble anode or anodes, with the surface of said electrolytic bath being wholly or partly covered with foam formed from the interaction of said electrolyte (including said surfactant), oxygen evolved from said electrolyte at said anode or anodes, and/or air or other gas entrained in said electrolyte, said foam suppressing misting of said electrolyte and release of said electrolyte into the atmosphere surrounding said electrolytic bath; and (f) recycling the resulting metal-depleted electrolyte for use as aqueous strip solution in step (c).

The present invention also provides an electrowinning bath containing foam-forming mist suppressant comprising fluoroaliphatic surfactant containing at least one cationogenic group which is the radical of a base having an ionization constant in water at 25° C. of at least about $10^{-6}$.

The invention inhibits or suppresses acidic mist formation above electrowinning tanks at low concentration of surfactant in the electrolytic bath. The compounds used in this invention do not readily dissolve in the water-immiscible organic solvent and do not seriously interfere with the rate of metal extraction by the ion exchange composition.

An additional advantage of the present invention is that in the process of solvent extraction-electrowinning of copper, copper deposited at the electrowinning cathode from an electrolytic bath containing fluoroaliphatic surfactants as described in this invention generally will be higher quality copper than copper deposited from a similar electrolytic bath which does not contain such surfactants. Such higher quality deposited copper has a fine grained microstructure, a smooth surface, and a reduced level of occluded, particulate impurities, and thus can be more readily drawn into small-diameter wire with reduced chance of breakage compared to lower quality copper containing occluded, particulate impurities. It should be noted that certain cationic fluoroaliphatic surfactants have been reported in U.S. Pat. No. 2,750,335 to give improved plating brightness when added to chromium electroplating baths. Also, a cationic fluoroaliphatic surfactant has been reported in "3M Brand Fluorochemical Surfactants Technical Information", pp. 36–37 (1963) to provide copper brightening in dip-coating, when used at 0.02 percent concentration of surfactant in the dip bath.

DETAILED DESCRIPTION

In the practice of the present invention, the electrolyte to be treated with the fluoroaliphatic surfactants used in this invention is ordinarily prepared by SX steps using conventional organic SX solvents, ion exchange compositions, and aqueous metal-bearing and electrolyte solutions, and generally conventional SX-EW processing conditions. Such organic SX solvents, ion exchange compositions, aqueous solutions, and processing conditions are well-known to those skilled in the art, and for purposes of brevity will not be described in great detail herein, reference being made to publications describing the SX-EW process such as those cited above, Agers et al., *Copper Recovery from Acid Solutions Using Liquid Ion Exchange,* Merigold et al., *LIX®6-4N—The Recovery of Copper from Ammoniacal Leach Solutions,* Kordosky, G. A., Ed., *The Chemistry of Metals Recovery Using LIX® Reagents,* (the latter three publications being publications of Henkel Corporation) and publications cited therein for further conventional details regarding the SX-EW process.

Acidic mist formation at the EW anode is minimized or eliminated in this invention by use of EW electrolyte containing a small quantity of certain fluoroaliphatic surfactants. Such surfactants lower the surface tension of the electrolyte and promote formation of a dense, stable foam at the EW anode. The surfactants used in this invention have low solubility in the organic phase employed in the SX process, are not readily extracted from the EW electrolyte, and do not seriously interfere with copper recovery by the ion exchange composition.

Fluoroaliphatic surfactants useful in this invention are organic molecules containing at least about 30 percent by weight fluorine in the form of carbon-bonded fluorine in at least one fluoroaliphatic radical $R_f$ and at least one cationogenic group which is the radical of a base having an ionization constant (the logarithm of the reciprocal of said ionization constant being referred to as pKb) in water at 25° C. of at least about $10^{-6}$. Fluoroaliphatic surfactants for use in this invention can also contain at least one anionogenic group which is the radical of an acid having an ionization constant (the logarithm of the reciprocal of said ionization constant being referred to as pKa) in water at 25° C. of at least about $10^{-6}$. Fluoroaliphatic surfactants which contain the above-mentioned cationogenic groups but do not contain such anionogenic groups in the same molecule will be referred to herein as cationic fluoroaliphatic surfactants. Fluoroaliphatic surfactants which contain such cationogenic and such anionogenic groups in the same molecule will be referred to herein as amphoteric fluoroaliphatic surfactants. Cationic, amphoteric, or mixtures of cationic and amphoteric fluoroaliphatic surfactants can be used in this invention, with amphoteric fluoroaliphatic surfactants and mixtures of cationic and amphoteric fluoroaliphatic surfactants being preferred.

$R_f$ is a fluorinated, monovalent, aliphatic, preferably saturated organic radical containing at least 4 carbon atoms. The skeletal chain of $R_f$ can be straight, branched, or, if sufficiently large, cyclic, and can include divalent oxygen atoms or trivalent nitrogen atoms bonded only to carbon atoms. Preferably, $R_f$ is fully fluorinated, but hydrogen or chlorine atoms can be present as substituents on the skeletal chain, provided that not more than one atom of either hydrogen or chlorine is present for every two carbon atoms in the skeletal chain, and $R_f$ contains at least a terminal perfluoromethyl group. While radicals containing a large number of carbon atoms will function adequately, compounds containing not more than about 20 carbon atoms are preferred since larger radicals usually represent a less efficient utilization of fluorine than is possible with shorter skeletal chains. Preferably, $R_f$ contains about 5 to 14 carbon atoms.

The cationogenic groups in said cationic and said amphoteric fluoroaliphatic surfactants are radicals of quaternary ammonium salts or radicals of cation-generating amines. Such amines can be oxygen-free (e.g. $—NH_2$) or oxygen-containing (e.g. amine oxides). Such cationogenic groups can have formulas such as $—NH_2$, $—(NH_3)X$, $—(NH(R^2)_2)X$, $—(N(R^2)_3)X$, or $—N(R^2)_2{\rightarrow}O$ where X is a co-anion such as halogen, hydroxide, sulfate, bisulfate or carboxylate, $R^2$ is H or $C_{1-18}$ and preferably $C_{1-6}$ alkyl, and each $R^2$ can be the same as or different from other $R^2$ Preferably $R^2$ is H or unsubstituted or substituted hydrocarbyl. Preferably, X is chloride, hydroxide, or bisulfate. Preferably, such surfactants contain a cationogenic group which is a quaternary ammonium salt.

The anionogenic groups in said amphoteric fluoroaliphatic surfactants are radicals of anions or are radicals which by ionization can become radicals of anions. The anionogenic groups can have formulas such as $—COOM$, $—SO_3M$, $—OSO_3M$, $—PO_3HM$, or $—OPO_3HM$, where M is H, a metal ion, or $N^+(R^1)_4$ where each $R^1$ is independently H or substituted or unsubstituted $C_{1-6}$ alkyl. Preferably M is $Na^+$ or $K^+$. Preferably such anionogenic groups have the formulas $—COOM$, $—SO_3M$ or $—PO_3HM$.

Such cationic fluoroaliphatic surfactants include those cationic fluorochemicals described, for example, in Guenthner and Vietor, *I & EC Product Res. & Dev.,* 1 (3) 165–9 (1962), and U.S. Pat. Nos. 2,732,398, 2,764,602, 2,764,603, 2,803,656, 2,809,990, 3,255,131, 4,000,168, 4,042,522, 4,069,158, 4,069,244, 4,090,967, 4,161,590, and 4,161,602.

Such amphoteric fluoroaliphatic surfactants include those amphoteric fluorochemicals described, for example, in Guenthner, R. A. and Vietor, M. L., id, Australian patent specification No. 432,809, and U.S. Pat. Nos. 2,764,602, 3,147,064, 3,450,755, 4,042,522, 4,069,158, 4,090,967, 4,161,590, and 4,161,602.

Representative fluoroaliphatic surfactants containing the above-mentioned cationogenic groups (and the above-mentioned anionogenic groups, if such surfactants are amphoteric) can be represented by several structural formulas, including formulas of nonionized (i.e., neutral) compounds and salts, including internal salts. Such representative surfactants include those of the formula shown below (in the form of salts):

$$R_f(Q)_a\left(\overset{R^3}{\underset{R^4}{C}}\right)_a(Q)_a(Z)_a\left(\overset{R^3}{N}\right)_a(Q)_a\left[\overset{R^5}{\underset{R^7}{N^+}}—R^6\right]_b[X^-]_b \quad \text{I}$$

wherein:

a is independently 0 or 1;

b is 1 or 2;

$R_f$ is a fluoroaliphatic radical as defined above, with the proviso that the molecule contains at least about 30 weight percent fluorine in the form of carbon-bonded fluorine in $R_f$;

Q is independently a polyvalent $$\text{(e.g., } —CH_2\overset{|}{C}HCH_2—\text{),}$$

generally divalent (e.g., $—CH_2—$, $—C_2H_4—$, $—C_3H_6—$, $—C_6H_4—$, $—CH_2SCH_2—$, and $—CH_2OCH_2—$), hydrocarbylene linking group of 1 to 12 carbon atoms which can contain catenary oxygen or sulfur, is unsubstituted or substituted by halogen, hydroxyl, or aryl, and is preferably free of aliphatic unsaturation, with the proviso that at least one Q group is present in the molecule;

$R^3$ is independently:

$R^4$ wherein $R^4$ is H or alkyl which is unsubstituted or substituted with halogen, hydroxyl, or aryl and contains no more than a total number of 18 carbon atoms, with $R^4$ preferably being saturated, unsubstituted $C_{1-6}$ alkyl;

$(Q)_aAM$ wherein A is $—COO^-$, $—SO_3^-$, $—OSO_3^-$, $—PO_3H^-$, or $—OPO_3H^-$, and M is as defined above; or $QNR^5R^6R^7$ wherein $R^5$ and $R^6$ are independently H, substituted or unsubstituted alkyl of 1 to 18 carbon atoms (preferably 1 to 6 carbon atoms), or together with the N atom form a cyclic aliphatic or aromatic ring which can contain additional O, S, or N atoms, and $R^7$ is $R^4$, a quaternary ammonium group containing no more than 20 carbon atoms, or $(Q)_aAM$;

Z is —CO— or $—SO_2—$; and

X is as defined above.

Useful subgenera of formula I include compounds of the formula (shown as internal salts):

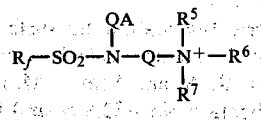

II wherein $R_f$ contains about 4 to 8 carbon atoms, Q is alkylene or hydroxyalkylene, A is $—COO^-$ or $—SO_3^-$, and $R^5$, $R^6$, and $R^7$ are alkyl or hydroxyalkyl; and

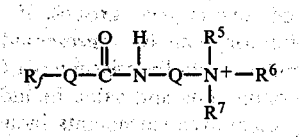

III wherein $R_f$ contains about 4 to 12 carbon atoms, Q is alkylene, $R^5$ and $R^6$ are lower alkyl, and $R^7$ is carboxyalkylene.

Representative cationic fluoroaliphatic surfactants useful in this invention include those listed below. While particular structures are shown, in strongly acidic aqueous solution such as electrowinning electrolyte the cationogenic group of such structures will exist primarily in the protonated or salt form, and, in neutral or basic solution the cationogenic group of such structures tends to be in the form of the free base; such solution-form structures are equivalents for purposes of the present invention.

$C_6F_{13}SO_2NHC_3H_6N(CH_3)_2$,
$[C_6F_{13}SO_2NHC_3H_6N^+(CH_3)_3]Cl^-$,
$C_6F_{13}SO_2NHC_3H_6N(CH_3)_2 \rightarrow O$,
$[C_6F_{13}SO_2NHC_3H_6N^+(CH_3)_2C_2H_4OH]OH^-$,
$C_6F_{13}SO_2N(C_2H_4OH)C_3H_6N(CH_3)_2$,
$[C_6F_{13}SO_2N(C_2H_4OH)C_3H_6N^+(CH_3)_2C_2H_4OH]OH^-$,
$[C_6F_{13}C_2H_4SO_2NHC_3H_6N^+(CH_3)_3]OH^-$,
$[C_7F_{15}CONHC_3H_6N^+(CH_3)_2H]Cl^-$,
$[C_8F_{17}SO_2NHC_3H_6N^+(CH_3)_3]I^-$,
$[C_8F_{17}SO_2NHC_3H_6N^+(CH_3)_3]_2\ SO_4^{2-}$,
$[C_8F_{17}SO_2NHC_3H_6N^+(CH_3)_3]O_3SOCH_3^-$,
$[C_8F_{17}C_2H_4N^+(CH_3)_2C_2H_4OH]OH^-$,
$[C_8F_{17}C_2H_4SC_2H_4CONHC_2H_4N^+(CH_3)_3]Cl^-$,

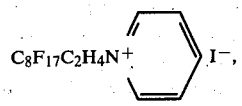

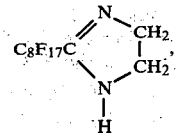

$C_{10}F_{19}OC_6H_4SO_2NHC_3H_6N(CH_3)_2$,
$(CF_3)_2CFOC_2F_4CONHC_3H_6N(CH_3)_2$, and mixtures thereof.

The cationic fluoroaliphatic surfactants used in this invention can be prepared using methods known in the art, such as those described in the above references relating to cationic fluorochemicals.

Representative amphoteric fluoroaliphatic surfactants useful in the practice of this invention are listed below. While particular structures are shown, in strongly acidic aqueous solution such as electrowinning electrolyte the anionogenic group of such structures may be partly or completely protonated and the cationogenic group of such structures will exist primarily in the protonated or salt form, and, in neutral or basic solution the anionogenic group of such structures tends to be negatively ionized and the cationogenic group of such structures tends to be in the form of the free base; such solution-form structures are equivalents for purposes of the present invention. For example, a compound of the formula $R_fSO_2N(CH_2COONa)C_3H_6N(CH_3)_2$ will have the formula $R_fSO_2N(CH_2COOH)C_3H_6N^+H(CH_3)_2\ HSO_4^-$ in aqueous sulfuric acid solution, and the formula $R_fSO_2N(CH_2COO^-Na^+)C_3H_6N(CH_3)_2$ in aqueous sodium hydroxide solution.

$C_4F_9SO_2NHC_3H_6N^+(CH_3)_2CH_2COO^-$,
$C_4F_9CON(C_3H_6SO_3^-)C_3H_6N^+(CH_3)_2C_2H_4COOH$,
$C_6F_{13}C_2H_4SC_2H_4N^+(CH_3)_2CH_2COO^-$,
$C_6F_{13}SO_2NHC_3H_6N^+(CH_3)_2CH_2COO^-$,
$C_6F_{13}SO_2NHC_3H_6N^+(CH_3)_2C_2H_4COO^-$,
$C_6F_{13}SO_2NHC_3H_6N^+(CH_3)_2C_3H_6SO_3^-$,
$[C_6F_{13}SO_2N(CH_2COONa)C_3H_6N^+(CH_3)_3]OH^-$,
$C_6F_{13}SO_2N(C_2H_4COONa)C_3H_6N^+(CH_3)_2C_2H_4COO^-$,

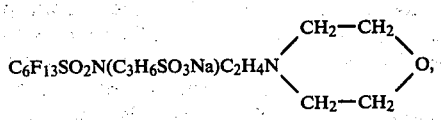

$C_6F_{13}SO_2N(C_3H_6SO_3Na)C_3H_6N(CH_3)_2$,
$C_6F_{13}SO_2N(C_3H_6SO_3^-)C_3H_6N^+(CH_3)_2C_2H_4OH$,
$C_6F_{13}SO_2N(CH_2CHOHCH_2SO_3Na)C_3H_6N(CH_3)_2$,
$C_6F_{13}SO_2N(CH_2CHOHCH_2SO_3^-)C_3H_6N^+(CH_3)_2C_2H_4OH$,
$[C_6F_{13}SO_2N(CH_2CHOHCH_2SO_3Na)C_3H_6N^+(CH_3)_2C_2H_4OH]OH^-$,
$C_6F_{13}C_2H_4SO_2N(CH_3)C_2H_4N^+(CH_3)_2C_2H_4COO^-$,
$C_7F_{15}CONHC_3H_6N^+(CH_3)_2C_2H_4COO^-$,
$C_7F_{15}CON(CH_2COO^-)C_3H_6N^+(CH_3)_3$,

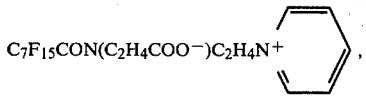

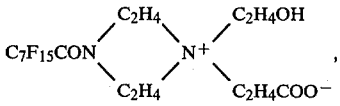

$C_7F_{15}C_2H_4SC_2H_4N^+(CH_3)_2CH_2COO^-$,
$C_8F_{17}CH_2CH(COO^-)N^+(CH_3)_3$,
$C_8F_{17}SO_2NHC_3H_6N^+(CH_3)_2C_3H_6SO_3^-$,
$C_8F_{17}SO_2N(C_2H_4PO_2OCH_3)^-C_3H_6N^+(CH_3)_3$,
$C_8F_{17}C_2H_4CONHC_3H_6N^+(CH_3)_2C_2H_4COO_-$, $$C_3F_6O\overset{CF_3}{\overset{|}{C}}FCF_2O\overset{CF_3}{\overset{|}{C}}FCON(C_3H_6SO_3^-)C_3H_6N^+(CH_3)_3,$$

$(CF_3)_2CFOC_3F_6CONHC_2H_4N^+(CH_3)_2C_2H_4COO^-$,
$C_{10}F_{19}OC_6H_4SO_2N(CH_2COONa)C_3H_6N(CH_3)_2$, and mixtures thereof.

The amphoteric fluoroaliphatic surfactants used in this invention can be prepared using methods known in the art, such as those described in the above references relating to amphoteric fluorochemicals.

Preferred fluoroaliphatic surfactants for use in this invention are $C_6F_{13}SO_2N(CH_2CHOHCH_2SO_3Na)C_3H_6N(CH_3)_2$, $[C_6F_{13}SO_2N(CH_2CHOHCH_2SO_3Na)C_3H_6N^+(CH_3)_2C_2H_4OH]OH^-$, and mixtures thereof, especially in the SX-EW processing of copper.

It should be noted that many of said fluoroaliphatic surfactants useful in the practice of this invention are mixtures of homologous fluorochemical compounds and can also contain fluoroaliphatic precursors and by-products from their preparation. Such mixtures are frequently just as useful as the individual fluorochemical compounds with respect to their surfactant properties. The fluoroaliphatic radical $R_f$ is often such a mixture (see, for example, Offenlegungschrift No. 2,357,916), and a fluoroaliphatic surfactant is frequently described in terms of the $R_f$ radical present in major proportion.

The fluoroaliphatic surfactants used in the present invention are added in amounts sufficient to minimize or suppress mist formation during electrowinning. Preferably, such surfactants have sufficient surface activity to provide a surface tension at 25° C. which is less than or equal to about 35 dynes/cm at a concentration of less than or equal to 0.02 wt % surfactant in an aqueous solution containing 120 g/liter $CuSO_4 \cdot 5H_2O$ and 150 g/liter 18M $H_2SO_4$. The amount of surfactant added to the electrowinning electrolyte will generally be between about one to 200 parts by weight of surfactant per million parts by weight of electrowinning electrolyte. Periodic replenishment of the surfactant will generally be needed in continuous SX-EW processing.

The fluoroaliphatic surfactants used in this invention can be added to the electrolyte periodically or continuously. Surfactants which are in solid form can, if desired, be added in solid form or in the form of solutions such as water solutions. Addition of surfactant can take place in the electrowinning cell or at other SX-EW processing locations such as the electrolyte exchanger, settling tanks, or mixing tanks.

Addition of the fluoroaliphatic surfactants used in this invention to an SX-EW processing stream can increase the time required for thorough phase separation of the organic phase and acid electrolyte. Such time required for thorough phase separation can be reduced by carrying out phase separation at an elevated temperature. For example, in SX-EW processing of copper, if the separation of organic phase and acid electrolyte was carried out at room temperature prior to the use of the present invention, then after addition of fluoroaliphatic surfactant according to the present invention, the organic phase and acid electrolyte can be heated to about 40° C to counteract any slowdown in phase separation caused by addition of fluoroaliphatic surfactant to the acid electrolyte.

The fluorochemical surfactants used in this invention provide stable, long lasting mist suppressing foams at low concentrations, e.g., 10 parts of surfactant per 1 million parts of electrolyte. Such foams are formed by the interaction of electrolyte (containing the surfactants used in this invention) with gases entrained in the electrolyte. Such gases are present due to the evolution of oxygen at the electrowinning anode and due to air or other gases which may be introduced by injection, mechanical agitation, or other means. The individual foam bubbles have a thin wall of electrolyte surrounding the entrained oxygen, air, or other gases. The foam bubbles rise to the surface of the electrolytic bath, aggregate, and can completely or partly cover the surface of the electrolytic bath.

In the SX-EW processing of copper, the fluoroaliphatic surfactants used in the present invention can provide improved quality of plated copper at the electrowinning cathode. When copper is electrowon according to the process of the present invention, and compared to copper which is electrowon under similar process conditions but in the absence of the fluoroaliphatic surfactants used in this invention, the former copper generally will be smoother, and have a finer grain structure. If particulate matter is present in the electrolyte, copper which is electrowon in the presence of the surfactants used in this invention generally will have a higher level of purity and will be more capable of being drawn into fine wires without breakage than copper which is electrowon without such surfactants. Under optical magnification (e.g. 70×), copper which is electrowon according to the present invention will generally have relatively smooth, regularly structured, sandy-appearing surface grain structure. In contrast, copper which is electrowon under similar process conditions but without the fluoroaliphatic surfactants used in this invention will generally have, at similar magnification, a pebbly or nodular surface grain structure with a coarse, uneven appearance.

Several anionic and non-ionic fluoroaliphatic surfactants were compared to the surfactants used in the present invention. Such anionic and non-ionic fluorochemicals failed to perform well in SX-EW processing of copper, as shown below in the comparative examples.

The following examples are offered to aid understanding of the present invention and are not to be construed as limiting the scope thereof. Surface tension data in the Examples which follow are uncorrected measurements made with a "Cenco duNouy" tensiometer. The surface tension values shown above and in the claims are true (i.e. corrected) values.

EXAMPLE 1

An electrolyte solution was prepared from the following ingredients:

Solution A 1. 120 g $CuSO_4 \cdot 5H_2O$
2. 150 g 18M $H_2SO_4$
3. 890 g deionized water
4. 0.050 g mixture of cationic and amphoteric fluoroaliphatic surfactants, in a water solution (weight shown is weight of surfactants, not weight of water solution).

Total electrolyte solution volume was 1 liter. The fluoroaliphatic surfactant mixture was prepared by adding 47 g $R_fSO_2NHC_3H_6N(CH_3)_2$ (where $R_f$ was principally $C_6F$—— and 47 g of the amine starting material was equivalent to about 0.1 mole) and 60 g $C_4H_9OC_2H_4OC_2H_4OH$ to a 250 ml 3-necked flask equipped with thermometer, agitator, and condenser. The resulting mixture was heated to 90° C. To the heated mixture was added 15 g ethylene carbonate (0.2 mole), 3 g water, and 0.5 g $Na_2CO_3$. This mixture was heated to 110° C. with agitation for 5 hours. The reaction product was cooled to 80° C. Next, 4.2 g solid NaOH (0.1 mole) was added to the reaction vessel and the resulting mixture was heated to 100° C for 2 hours. The pressure in the reaction vessel was gradually reduced and heating was continued until the pressure over the reaction mixture reached 100 mm Hg and the temperature of the reaction mixture reached 125° C. The reaction mixture was cooled to 90° C., and contained the intermediate $[C_6F_{13}SO_2N(Na)C_3H_6N^+(CH_3)_2C_2H_4OH]$ $OH^-$. Next, 23.1 g $ClCH_2CHOHCH_2SO_3Na$ (about 90 percent pure) was added to the reaction vessel and the resulting mixture heated to 110° C. for 5 hours. The reaction mixture was cooled to 90° C., mixed with 120 g water, and cooled to room temperature. The reaction product was a mixture containing the amphoteric fluoroaliphatic surfactant $[C_6F_{13}SO^2N(CH_2CHOHCH_2SO_3Na)C_3H_6N^+(CH_3)_2C_2H_4OH]OH^-$ as well as unreacted starting material, unreacted intermediate, and other fluorochemical by-products. This reaction product was considered to have 30 percent by weight fluoroaliphatic surfactant content.

A 150 g portion of Solution A was added to a 250 ml beaker equipped with a lead anode, a copper cathode having an area of 11.0 $cm^2$ on each side, and a magnetic stirrer. The surface tension of the electrolyte was measured at about 25° C. and found to be 24 dynes/cm. Electroplating was initiated at a current density of 0.153 ampere/$cm^2$ and a temperature of 22° C. Foam quickly formed around the anode and pH paper did not change to reddish (acid) color when held above the electrolyte, indicating that the air above the electrolyte was essentially free of acidic mist. In a comparison run, the same electrolyte was prepared without addition of fluorochemical, and no foam formed at the anode and pH paper changed to red in color when held above the electrolyte, indicating that the air above the electrolyte contained acidic mist.

A long-term plating run was then carried out. The electroplating apparatus was operated for three hours using the fluorochemical-containing electrolyte of Solution A. Hourly additions of $CuSO_4 \cdot 5H_2O$ were made to the electrolyte to replace copper which had been plated out at the cathode. After 3 hours, the foam at the anode was still effective as a mist inhibitor, as no change in the color of pH paper was observed when the pH paper was held above the electrolyte. The electroplating current and stirrer were turned off. The surface tension of the electrolyte was measured at about 25° C. and found to be 25 dynes/cm, indicating that there had been little, if any, loss of surfactant.

Two solutions were next prepared from the following ingredients, for evaluation of the resistance of the fluorochemical to extraction into the organic phase during a cyclic SX process:

Solution B 1. 11.8 g $CuSO_4 \cdot 5H_2O$
2. 988.2 g deionized water
3. sufficient 18M $H_2SO_4$ to adjust the pH of the solution to 2.2

Solution C 1. 70 ml "Acorga P5300", organic, monomeric, hydroxyoxime chelating agent commercially available from Imperial Chemical Industries, Ltd.
2. 930 ml "Kermac 470B" petroleum distillate, commercially available from Kerr-McGee, Inc.

A 100 ml portion of Solution B was vigorously stirred with a 100 ml portion of Solution C in a separatory funnel for 10 minutes. The organic and aqueous phases were allowed to separate and the aqueous phase then drawn off and discarded. A 100 ml portion of said Solution A (but containing only 0.0035 g of the fluoroaliphatic surfactant mixture instead of the 0.050 g/liter amount recited above) was then added to the separatory funnel and vigorously stirred with the organic phase for 10 minutes. The aqueous phase was drawn off, labeled as "Solution $A_1$", and subjected to electroplating as described above to demonstrate that foaming occurred. Electrolysis was then discontinued and Solution $A_1$ was set aside. Next, 100 ml of fresh Solution B was added to the organic phase remaining in the separatory funnel, the aqueous and organic phases were vigorously stirred for 10 minutes, and the lower aqueous phase was discarded as before. Solution $A_1$ was added to the separatory funnel, vigorously stirred for 10 minutes, and the lower aqueous phase drawn off and labeled as "Solution $A_2$". Solution $A_2$ was subjected to electroplating as described above. In this fashion, the electrolyte and organic phase were continually recycled, and successive extracts of electrolyte were labeled "Solution $A_3$", "Solution $A_4$", etc., and subjected to electroplating. Foaming continued through the sixth testing cycle (Solution $A_6$), and the run was then terminated. The surface tension of Solution $A_6$ was measured at about 25° C. and found to be 32 dynes/cm, indicating that the surfactant was still present in active amount.

This example shows that low concentrations of a mixture of cationic and amphoteric fluoroaliphatic surfactants in electrolyte give effective mist suppression at the electrowinning anode. The fluorochemical mixture resisted extraction by the organic SX phase and resisted plating out at the electrowinning cathode.

EXAMPLES 2 to 10

The long-term plating and cyclic SX procedures of EXAMPLE 1 were repeated using several other cationic or amphoteric fluoroaliphatic surfactants in place of the surfactant mixture used in EXAMPLE 1. Set out below in Table I are results for the long-term plating procedure, including example number, fluorochemical identity, initial weight percent fluorochemical added to the electrolyte, number of hours of plating, initial surface tension, and surface tension after the long-term plating procedure was ended. Initial fluorochemical concentrations were adjusted to give foaming at minimal addition level.

TABLE I

| Example No. | Fluorochemical | Weight % fluorochemical | Plating hours | Surface tension of electrolyte, dynes/cm at start of run | at end of run |
|---|---|---|---|---|---|
| 2 | $[C_6F_{13}SO_2N(CH_2COONa)—C_3H_6N^+(CH_3)_3]OH^-$ | 0.005 | 2–3 | 24 | 36 |
| 3 | $C_6F_{13}SO_2NHC_3H_6N^+—(CH_3)_2CH_2COO^-$ | 0.0075 | 1–2 | 21.5 | 37 |
| 4 | $C_6F_{13}SO_2NHC_3H_6—N^+(CH_3)_2C_2H_4COO^-$ | 0.005 | 3+ | 23.2 | 23.6 |
| 5 | $C_6F_{13}SO_2N(CH_2CHOH—CH_2SO_3Na)C_3H_6N(CH_3)_2$ | 0.005 | 2+ | 25.3 | 28.5 |
| 6 | $C_7F_{15}CONHC_3H_6N^+—(CH_3)_2C_2H_4COO^-$ | 0.005 | 1–2 | 32 | 42 |
| 7 | $C_6F_{13}SO_2N(C_2H_4COONa)—C_3H_6N^+(CH_3)_2C_2H_4COO^-$ | 0.005 | 2–3 | 24 | 36 |
| 8 | $[C_8F_{17}SO_2NHC_3H_6N^+—(CH_3)_3]I^-$ | 0.01 | 1–2 | 23 | 33 |
| 9 | $[C_8F_{17}SO_2NHC_3H_6—N^+(CH_3)_3]_2SO_4^{2-}$ | 0.005 | 1–2 | 24 | 31 |
| 10 | $[C_6F_{13}SO_2NHC_3H_6—N^+(CH_3)_2C_2H_4OH]OH^-$ | 0.05 | 2–3 | 25 | 34.5 |

Set out below in Table II are results for the cyclic SX run, including the example number, fluorochemical identify, initial weight percent fluorochemical added to the electrolyte, number of successful SX cycles (i.e., the number of SX cycles through which foaming was observed within 3 minutes of the start of electroplating), initial surface tension, and surface tension after SX cycling had been carried out to the point that the electrolyte solution would not foam within 3 minutes after the start of electroplating. A "+" in the column "No. of successful SX cycles" indicates that foaming was observed in all run cycles and the run was discontinued after the indicated number of cycles.

TABLE II

| Example No. | fluorochemical | Weight % fluorochemical | No. of successful SX cycles | Surface tension of electrolyte, dynes/cm at start of run | at end of run |
|---|---|---|---|---|---|
| 2 | $[C_6F_{13}SO_2N(CH_2COONa)—C_3H_6N^+(CH_3)_3]OH^-$ | 0.025 | 4+ | 22 | 25 |
| 3 | $C_6F_{13}SO_2NHC_3H_6N^+—(CH_3)_2CH_2COO^-$ | 0.01 | 3 | 21 | 38 |
| 4 | $C_6F_{13}SO_2NHC_3H_6—N^+(CH_3)_2C_2H_4COO^-$ | 0.005 | 1 | 23 | 30 |
| 5 | $C_6F_{13}SO_2N(CH_2CHOH—CH_2SO_3Na)C_3H_6N(CH_3)_2$ | 0.004 | 7 | 26 | 34 |
| 6 | $C_7F_{15}CONHC_3H_6N^+—(CH_3)_2C_2H_4COO^-$ | 0.005 | 2 | 26 | 37 |
| 7 | $C_6F_{13}SO_2N(C_2H_4COONa)—C_3H_6N^+(CH_3)_2C_2H_4COO^-$ | 0.005 | 3 | 23 | 30 |
| 8 | $[C_8F_{17}SO_2NHC_3H_6N^+—(CH_3)_3]I^-$ | 0.01 | 5+ | 23 | 23.5 |
| 9 | $[C_8F_{17}SO_2NHC_3H_6—N^+(CH_3)_3]_2SO_4^{2-}$ | 0.025 | 5 | 20 | 36 |
| 10 | $[C_6F_{13}SO_2NHC_3H_6—N^+(CH_3)_2C_2H_4OH]OH^-$ | 0.004 | 4 | 25 | 32 |

COMPARATIVE EXAMPLE

Several anionic and non-ionic fluorochemicals were evaluated for comparison as mist suppressants using the SX procedures of EXAMPLE 1. Set out below in Table III are the results, including run number, fluorochemical identity, fluorochemical type (anionic or non-ionic), initial weight percent fluorochemical added to the electrolyte, number of successful SX cycles, initial surface tension, and surface tension after SX cycling had been carried out to a point at which the electrolyte solution would not foam within 3 minutes of the start of electroplating. Initial fluorochemical concentrations were adjusted to give foaming (where possible) at minimal addition levels.

TABLE III

| Run No. | Fluorochemical | Type | Weight % fluoro-chemical | No. of successful SX cycles | Surface tension of electrolyte, dynes/cm at start of run | at end of run |
|---|---|---|---|---|---|---|
| 1 | $C_8F_{17}SO_3K$ | anionic | 0.05 | 0 | 21 | 43 |
| 2 | $C_2F_5$—cyclo-$C_6F_{10}SO_3K$ | anionic | 0.05 | 0 | 28 | 41 |
| 3 | $C_8F_{17}SO_2N(C_2H_5)$—$C_2H_4OSO_3Na$ | anionic | 0.05 | 0 | 21 | 34 |
| 4 | $C_8F_{17}SO_2NHC_6H_4$—$SO_3Na$ | anionic | 0.05 | 0 | 22 | 37 |
| 5 | $C_7F_{17}COONH_4$ | anionic | no foam | | | |
| 6 | $C_8F_{17}SO_2N(CH_2$—$C_6H_4SO_3Na)_2$ | anionic | no foam | | | |
| 7 | $C_8F_{17}SO_2NHC_3H_6$—$PO(OH)_2$ | anionic | 0.03 | 0 | 20 | 37 |
| 8 | $(C_8F_{17}SO_2N(C_2H_5)$—$C_2H_4O)_2PO_2^-NH_4^+$ | anionic | insoluble | | | |
| 9 | $C_8F_{17}SO_2N(C_2H_5)$—$(C_2H_4O)_7CH_3$ | non-ionic | 0.03 | 1 | 22 | 45 |
| 10 | $C_8F_{17}SO_2N(C_2H_5)$—$(C_2H_4O)_{39}CH_3$ | non-ionic | 0.03 | 0 | 29 | 46 |

Various modifications and alterations of this invention will be apparent to those skilled in the art without departing from the scope and spirit of this invention and the latter should not be restricted to that set forth herein for illustrative purposes.

What is claimed is:

1. A process for recovery of metal values by liquid-liquid solvent extraction of said metal values from metal-bearing aqueous solution, stripping of said metal values into acidic aqueous solution containing strong acid, and electrowinning of said metal values from an electrolytic cell, said cell comprising a metallic cathode, one or more insoluble anodes, and electrolyte containing said strong acid and said metal values, said process including recycling of said electrolyte, wherein the improvement comprises electrowinning said metal values from electrolyte containing sufficient fluoroaliphatic surfactant to provide mist-inhibiting foam on the surface of said electrolyte, said surfactant having at least one cationogenic group which is the radical of a base having an ionization constant in water at 25° C. of at least about $10^{-6}$, and containing at least about 30 weight percent fluorine in the form of carbon-bonded fluorine in a fluoroaliphatic radical, said fluoroaliphatic radical having at least 4 carbon atoms and at least a terminal perfluoromethyl group.

2. A process according to claim 1, wherein said surfactant also has at least one anionogenic group which is the radical of an acid having an ionization constant in water at 25° C. of at least about $10^{-6}$.

3. A process according to claim 1, wherein said metal values comprise nickel.

4. A process according to claim 1, wherein said metal values comprise copper.

5. A process according to claim 1, wherein said surfactant comprises compounds of the formula:

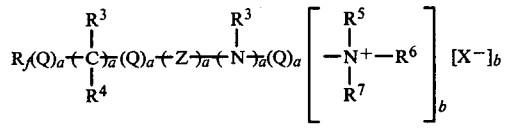

wherein:

a is independently 0 or 1;

b is 1 or 2;

$R_f$ is a fluorinated, monovalent, aliphatic radical, with the proviso that the molecule contains about 30 weight percent fluorine in the form of carbon-bonded fluorine in $R_f$;

Q is independently a linking group, with the proviso that at least one Q group is present in the molecule;

$R_3$ is independently:

$R_4$ wherein $R_4$ is H or alkyl;

$(Q)_aAM$ wherein A is $—COO^-$, $—SO_3^-$, $—OSO_3^-$, $—PO_3H^-$, or $—OPO_3H^-$, and M is $H^+$, a metal ion, or $N^+(R^1)_4$ where each $R^1$ is independently H or alkyl; or $QNR^5R^6R^7$ wherein $R^5$ and $R^6$ are independently H, alkyl, or together with the N atom to which $R^5$ and $R^6$ are attached form a cyclic ring, and $R^7$ is $R^4$, a quaternary ammonium group, or $(Q)_aAM$;

Z is —CO— or $—SO_2—$; and

X is halogen, hydroxide, sulfate, bisulfate, or carboxylate.

6. A process according to claim 5, wherein said surfactant comprises compounds of the formula:

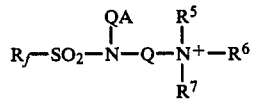

wherein $R_f$ contains about 4 to 8 carbon atoms, Q is alkylene or hydroxyalkylene, A is $—COO^-$ or $—SO_3^-$, and $R^5$, $R^6$, and $R^7$ are alkyl or hydroxyalkyl.

7. A process according to claim 5, wherein said surfactant comprises compounds of the formula:

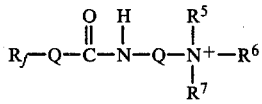

wherein $R_f$ contains about 4 to 12 carbon atoms, Q is alkylene, $R^5$ and $R^6$ are lower alkyl, and $R^7$ is carboxyalkylene.

8. A process according to claim 2, wherein said surfactant comprises about 1 to 200 parts by weight $[C_6F_{13}SO_2N(CH_2CHOHCH_2SO_3Na)C_3H_6N^+(CH_3)_2C_2H_4OH]OH^-$ per one million parts by weight of said electrolyte.

9. A process according to claim 2, wherein said surfactant comprises about 1 to 200 parts by weight $C_6F_{13}SO_2N(CH_2CHOHCH_2SO_3Na)C_3H_6N(CH_3)_2$ per one million parts by weight of said electrolyte.

10. A process for the recovery of metal values from metal-bearing aqueous solutions, comprising the steps of:

(a) mixing said metal-bearing aqueous solution with water-immiscible organic solvent containing water-insoluble organic ion exchange composition, said composition having selective affinity for said metal values, thereby forming metal-bearing organic solution and metal-depleted aqueous solution;

(b) separating said metal-bearing organic solution and said metal-depleted aqueous solution;

(c) contacting said metal-bearing organic solution with aqueous strip solution comprising strong acid and less than or equal to 0.02 weight percent of fluoroaliphatic surfactant, said surfactant having at least one cationogenic group which is the radical of a base having an ionization constant in water at 25° C. of at least about $10^{-6}$, and containing at least about 30 weight percent fluorine in the form of carbon-bonded fluorine in a fluoroaliphatic radical, said fluoroaliphatic radical having at least 4 carbon atoms and at least a terminal perfluoromethyl group, thereby forming metal-enriched aqueous strip solution and metal-depleted organic solution, said metal-enriched aqueous strip solution having a surface tension at 25° C. which is less than or equal to about 35 dynes/cm;

(d) separating said metal-depleted organic solution and said metal-enriched aqueous strip solution;

(e) electroplating said metal values onto a metallic cathode using said metal-enriched aqueous strip solution as electrolyte in an electrolytic bath, by passing direct electric current between said cathode and an insoluble anode or anodes, with the surface of said electrolytic bath being wholly or partly covered with foam formed from the interaction of said electrolyte, oxygen evolved from said electrolyte at said anode or anodes, and/or air or other gas entrained in said electrolyte, said foam suppressing misting of said electrolyte and release of said electrolyte into the atmosphere surrounding said electrolytic bath; and (f) recycling the resulting metal-depleted electrolyte for use as aqueous strip solution in step (c).

11. A process according to claim 10, wherein said surfactant also has at least one anionogenic group which is the radical of an acid having an ionization constant in water at 25° C. of at least about $10^{-6}$.

12. A process according to claim 10, wherein said metal comprises nickel.

13. A process according to claim 10, wherein said metal comprises copper.

14. A process according to claim 10, wherein said surfactant comprises compounds of the formula:

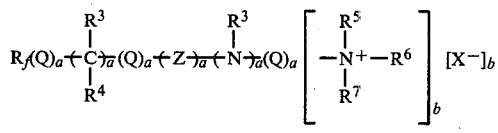

wherein:

a is independently 0 or 1;

b is 1 or 2;

$R_f$ is a fluorinated, monovalent, aliphatic radical, with the proviso that the molecule contains about 30 weight percent fluorine in the form of carbon-bonded fluorine in $R_f$;

Q is independently a linking group, with the proviso that at least one Q group is present in the molecule;

$R_3$ is independently:

$R^4$ wherein $R^4$ is H or alkyl;

$(Q)_aAM$ wherein A is $—COO^-$, $—SO_3^-$, $—OSO_3^-$, $—PO_{3H}^-$, or $—OPO_3H^-$, and M is $H^+$, a metal ion, or $N^+(R^1)_4$ where each $R^1$ is independently H or alkyl; or $QNR^5R^6R^7$ wherein $R^5$ and $R^6$ are independently H, alkyl, or together with the N atom to which $R_5$ and $R_6$ are attached form a cyclic ring, and $R_7$ is $R^4$, a quaternary ammonium group, or $(Q)_aAM$;

Z is —CO— or $—SO_2—$; and

X is halogen, hydroxide, sulfate, bisulfate, or carboxylate.

15. A process according to claim 14, wherein said surfactant comprises compounds of the formula:

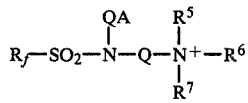

wherein $R_f$ contains about 4 to 8 carbon atoms, Q is alkylene or hydroxyalkylene, A is $—COO^-$ or $—SO_3^-$, and $R^5$, $R^6$, and $R^7$ are alkyl or hydroxyalkyl.

16. A process according to claim 14, wherein said surfactant comprises compounds of the formula:

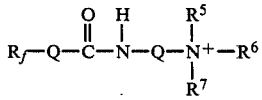

wherein $R_f$ contains about 4 to 12 carbon atoms, Q is alkylene, $R^5$ and $R^6$ are lower alkyl, and $R^7$ is carboxyalkylene.

17. A process according to claim 11, wherein said surfactant comprises about 1 to 200 parts by weight $[C_6F_{13}SO_2N(CH_2CHOHCH_2SO_3Na)C_3H_6N^+(CH_3)_2C_2H_4OH]OH^-$ per one million parts by weight of said strip solution.

18. A process according to claim 11, wherein said surfactant comprises about 1 to 200 parts by weight $C_6F_{13}SO_2N(CH_2CHOHCH_2SO_3Na)C_3H_6N(CH_3)_2$ per one million parts by weight of said strip solution.

* * * * *